US006747527B2

(12) United States Patent
Nakamura et al.

(10) Patent No.: US 6,747,527 B2
(45) Date of Patent: Jun. 8, 2004

(54) DIELECTRIC DUPLEXER AND COMMUNICATION APPARATUS

(75) Inventors: Soichi Nakamura, Omihachiman (JP); Hirofumi Miyamoto, Kanazawa (JP)

(73) Assignee: Murata Manufacturing Co. Ltd (JP)

( * ) Notice: Subject to any disclaimer, the term of this patent is extended or adjusted under 35 U.S.C. 154(b) by 79 days.

(21) Appl. No.: 10/278,146

(22) Filed: Oct. 22, 2002

(65) Prior Publication Data

US 2003/0076196 A1 Apr. 24, 2003

(30) Foreign Application Priority Data

Oct. 22, 2001 (JP) ..... 2001-324057

(51) Int. Cl.[7] ..... H01P 1/213; H01P 1/202; H01P 1/205

(52) U.S. Cl. ..... 333/126; 333/127; 333/134; 333/203; 333/206

(58) Field of Search ..... 333/126, 127, 333/129, 132, 134, 202, 203, 206, 207

(56) References Cited

U.S. PATENT DOCUMENTS 4,896,124 A * 1/1990 Schwent ..... 333/206
5,239,279 A * 8/1993 Turunen et al. ..... 333/134
5,534,829 A * 7/1996 Kobayashi et al. ..... 333/126
5,870,006 A * 2/1999 Tada et al. ..... 333/202
5,986,521 A * 11/1999 Tada et al. ..... 333/134
6,177,852 B1 * 1/2001 Tada et al. ..... 333/202

* cited by examiner

*Primary Examiner*—Barbara Summons
(74) *Attorney, Agent, or Firm*—Dickstein, Shapiro, Morin & Oshinsky, LLP.

(57) ABSTRACT

A dielectric duplexer includes a substantially-rectangular-parallelepiped-shaped dielectric block. The interior of the dielectric block includes inner-conductor-formed holes containing inner conductors. An outer conductor is formed on the substantial entirety of an exterior surface of the dielectric block. Input/output electrodes and antenna input/output electrodes are formed at predetermined positions. Thus, the dielectric block is provided with a band eliminate filter and a band pass filter. A C-L-C $\pi/2$ phase circuit in which C, L, and C are arranged in the shape of the letter $\pi$ is provided between an antenna and the antenna input/output electrode of the band eliminate filter, and the antenna is connected to the antenna input/output electrode of the band pass filter.

20 Claims, 10 Drawing Sheets

DIELECTRIC DUPLEXER AND COMMUNICATION APPARATUS

BACKGROUND OF THE INVENTION

1. Field of the Invention

The present invention relates to dielectric duplexers mainly for use in mobile communication, to radio frequency (RF) modules, and to communication apparatuses including the same.

2. Description of the Related Art

Referring to FIG. 7, the configuration of a known dielectric duplexer will now be described.

FIG. 7 is an external perspective view of a dielectric duplexer.

Referring to FIG. 7, the dielectric duplexer includes a dielectric block 51, inner-conductor-formed holes 52*a* to 52*f*, containing inner conductors 53*a* to 53*f*, an outer conductor 54, an input/output electrode 55, outer-conductorless portions 56 and 58, an antenna input/output electrode 57, and an inner-conductor-formed hole 59 functioning as an antenna excitation hole.

The substantially-rectangular-parallelepiped-shaped dielectric block 51 includes the inner-conductor-formed holes 52*a* to 52*f*, containing the inner conductors 53*a* to 53*f*, respectively. The outer conductor 54 is formed on the entirety of an exterior surface of the dielectric block 51. In the interior near an end face having first ends of the inner-conductor-formed holes 52*a* to 52*f* (the right back side in FIG. 7), inner-conductorless portions are provided to isolate the inner conductors 53*a* to 53*f* from the outer conductor 54, and hence the first ends become open-circuited ends. Second ends opposing the open-circuited ends (the left front side in FIG. 7) are short-circuited ends. As a result, dielectric resonators are formed. The inner-conductor-formed hole 59 is formed to penetrate the dielectric block 51 in the same axial direction as that of the inner-conductor-formed holes 52*a* to 52*f*.

On the exterior surface of the dielectric block 51, the input/output terminal 55 extends from an end face in the direction in which the inner-conductor-formed holes 52*a* to 52*f* are arrayed to a mounting face (bottom face in FIG. 7) opposing a mounting board. The input/output terminal 55 is separated from the outer conductor 54 by the outer-conductorless portion 56 therebetween. Between the inner-conductor-formed holes 52*c* and 52*d*, the antenna input/output electrode 57 is formed to extend from the short-circuited end face having the short-circuited ends of the inner-conductor-formed holes 52*a* to 52*f* to the mounting face. The antenna input/output electrode 57 is separated from the outer conductor 54 by the outer-conductorless portion 58 therebetween. The antenna input/output electrode 57 is connected to an inner conductor in the inner-conductor-formed hole 59.

In this state, a first portion including the inner-conductor-formed holes 52*a* to 52*c* and a second portion including the inner-conductor-formed holes 52*d* to 52*f* each function as a three-stage band-pass-type dielectric filer in which the resonators formed by the inner conductors are coupled to one another. Thus, the dielectric duplexer having one of the filters as a transmitter filter and the other filter as a receiver filter is formed.

The above-described known dielectric duplexer has the following problems.

In the known dielectric duplexer, when the transmitter filter and the receiver filter are both band pass filters, the impedance in each of the pass bands of the transmitter filter and the receiver filter as seen from the antenna input/output electrode is substantially infinite. Thus, the transmitter filter and the receiver filter function as a dielectric duplexer.

FIG. 8 shows the equivalent circuit of a dielectric duplexer in which one of the filters is a band eliminate filter. In this case, as shown in FIG. 9, the impedance of the band eliminate filter in the pass band of the band pass filter is substantially zero.

FIG. 9 is a Smith chart showing the impedance of the transmitter filter (band eliminate filter) as seen from the antenna in the reception band (pass band) of the receiver filter (band pass filter). The Smith chart shows the impedance of a communication system in the 800 MHz band (the pass band of the receiver filter ranges from 810 MHz to 828 MHz), wherein symbol A indicates the impedance at 810 MHz and symbol B indicates the impedance at 828 MHz.

As shown in FIG. 9, the impedance of the transmitter filter as seen from the antenna is substantially zero, and hence the transmitter filter as seen from the antenna is essentially short-circuited in the reception band. This causes a reception signal from the antenna to enter the transmitter filter. As a result, the transmitter filter and the receiver filter do not function as a duplexer.

In order to solve this problem, a dielectric duplexer arranged as shown in FIGS. 10A to 10C is devised.

FIGS. 10A to 10C are three partial views of the dielectric duplexer, namely, FIGS. 10A and 10C illustrating faces having apertures of inner-conductor-formed holes and FIG. 10B illustrating the bottom face, which is a mounting face. FIGS. 10A to 10C show a band eliminate filter, which is one of the filters forming the dielectric duplexer.

Referring to FIGS. 10A to 10C, the dielectric duplexer includes a dielectric block 61, inner-conductor-formed holes 62*a* to 62*d*, 70, and 71, an outer conductor 64, outer-conductorless portions 66 and 68, an input/output electrode 67, and an antenna input/output electrode 69.

In the dielectric duplexer shown in FIGS. 10A to 10C, the inner-conductor-formed holes 62*a* to 62*d*, 70, and 71, containing inner conductors, are formed to extend from a first face of the dielectric block 61 (FIG. 10A) to a second face opposing the first face (FIG. 10C). The inner-conductor-formed holes 62*a*, 62*c*, 62*d*, 70, and 71 each have a stepped structure formed by portions having different internal diameters. The inner-conductor-formed hole 62*b* has a straight structure. The outer conductor 64 is formed on the substantial entirety of an exterior surface of the dielectric block 61. The outer-conductorless portions 66 and 68 are provided to extend from the first face (FIG. 10A) to the bottom face, which is the mounting face (FIG. 10B). This results in the formation of the input/output electrode 67 and the antenna input/output electrode 69. The inner-conductor-formed holes 70 and 71 are connected to the input/output electrode 67 and the antenna input/output electrode 69, respectively. An inner-conductorless portion is provided in the interior near the first face (FIG. 10A) including the input/output electrode 67 and the antenna input/output electrode 69, and hence an open-circuited end of a resonator formed by the inner-conductor-formed hole 62*c* is formed. Inner-conductorless portions are provided in the interior near the second face opposing the first face (FIG. 10C), and hence open-circuited ends of resonators formed by the inner-conductor-formed holes 62*a* and 62*d* are formed.

The inner-conductor-formed holes 62*a* to 62*d*, 70, and 71 are arranged in two lines from the bottom face to the top face of the dielectric block 61. The resonators formed by the inner-conductor-formed holes 62*a*, 70, 62*c*, and 62*d* form two one-stage band eliminate filters by interdigitally coupling the inner-conductor-formed hole 62*a* with the inner-conductor-formed hole 70 and by interdigitally coupling the inner-conductor-formed hole 62*c* with the inner-conductor-formed hole 62*d*. The one-stage band eliminate filters are interdigitally coupled to each other at an electrical angle of $\pi/2$ between the inner-conductor-formed hole 70 and the inner-conductor-formed hole 62*d*. As a result, a two-stage band eliminate filter is formed.

The resonator formed by the inner-conductor-formed hole 71 functions as a $\pi/2$ phase circuit by interdigitally coupling to the resonator formed by the inner-conductor-formed hole 62*d* at an electrical angle of $\pi/2$. The band eliminated by the band eliminate filter, as seen from the antenna input/output electrode 69, i.e., the impedance of the band eliminate filter in the pass band of the band pass filter, can be increased to be substantially infinite. As a result, the filter functions as a duplexer.

This arrangement causes the following problem. Specifically, the interdigital coupling of the resonator formed by the inner-conductor-formed hole 62*d* with three resonators formed by the inner-conductor-formed holes 62*c*, 70, and 71 requires the inner-conductor-formed holes to be arranged at two stages at different heights. This results in an increase in the height of the dielectric block 61.

Compared with the one-stage structure, the two-stage structure can only allow smaller space in the height direction per resonator. This causes deterioration of the unloaded Q factor and an increase in the insertion loss.

The phase width in the reception band (the pass band of the band pass filter) changes as shown in FIG. 11.

The larger the number of resonators formed by the inner-conductor-formed holes forming the filters, the larger the number of devices having frequency characteristics.

FIG. 11 is a Smith chart showing the impedance of the transmitter filter in the reception band as seen from the antenna input/output electrode. The Smith chart shows the impedance of a communication system in the 800 MHz band (the pass band of the receiver filter ranges from 810 MHz to 828 MHz), wherein symbol A indicates the impedance at 810 MHz and symbol B indicates the impedance at 828 MHz. As shown in FIG. 11, the phase width $\theta$ is variable depending on the range of frequencies in the reception band. The receiver filter cannot have sufficient matching over the entire range of frequencies in the reception band, resulting in an increase in the insertion loss.

Also, the dielectric block increases in size. This increase causes an increase in material cost, leading to an increase in the overall cost.

SUMMARY OF THE INVENTION

Accordingly, it is an object of the present invention to provide a dielectric duplexer with a simple configuration, which includes a band eliminate filter as one of two filters and which can easily have matching with an antenna, and to provide a communication apparatus including the same.

According to an aspect of to the present invention, a dielectric duplexer is provided including a dielectric block including two filters, each filter including two input/output electrodes, one of which is an antenna input/output electrode. At least one of the filters is a band eliminate filter. The exterior of the dielectric block includes a phase circuit between the antenna input/output electrode of the band eliminate filter and an antenna. The phase is shifted by the phase circuit so that the antenna input/output electrode of the band eliminate filter, as seen from the antenna, is essentially open-circuited. Accordingly, a miniaturized dielectric duplexer having improved characteristics can be formed at low cost.

Of the two filters, one may be the band eliminate filter, and the other may be a band pass filter. The antenna may be connected to the antenna input/output electrode of the band pass filter.

The band eliminate filter forming the dielectric duplexer may be formed by a plurality of resonators, which are interdigitally coupled to one another. Accordingly, a filter with low loss can be formed, and a dielectric duplexer having improved characteristics can be formed.

The phase circuit and the dielectric block including a plurality of dielectric filters may be mounted on a single substrate. Accordingly, a dielectric duplexer can be formed by a simple configuration, and the degree of freedom in designing the dielectric duplexer can be enhanced.

According to another aspect of the present invention, a communication apparatus including the foregoing dielectric duplexer is provided. Accordingly, a communication apparatus having improved communication characteristics can be formed.

DESCRIPTION OF THE PREFERRED EMBODIMENTS

Referring to FIGS. 1A to 1C and 2, the configuration of a dielectric duplexer according to a first embodiment of the present invention will now be described.

Figure 1A:
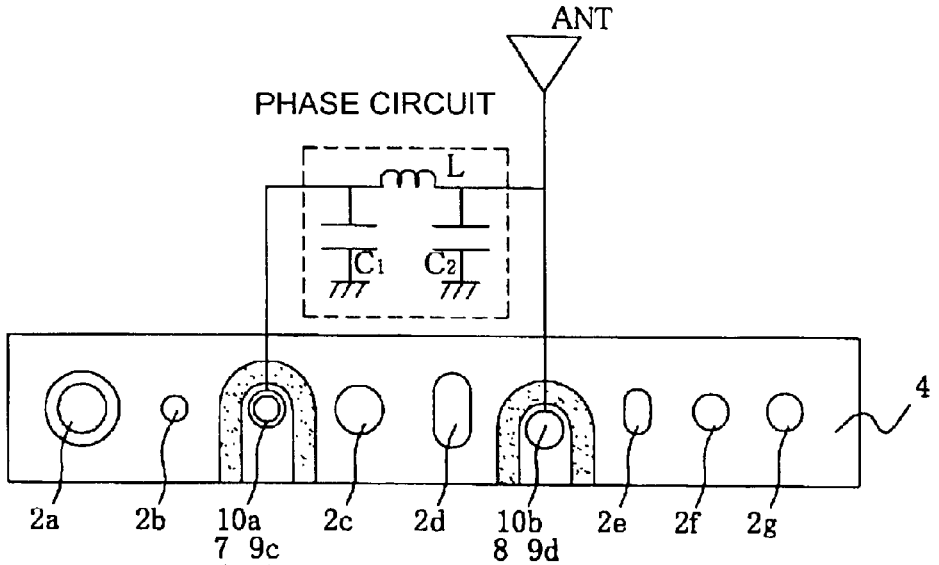
FIGS. 1A to 1C are three side views of a dielectric duplexer, having externally-connected devices, according to a first embodiment of the present invention.
Figure 1B:
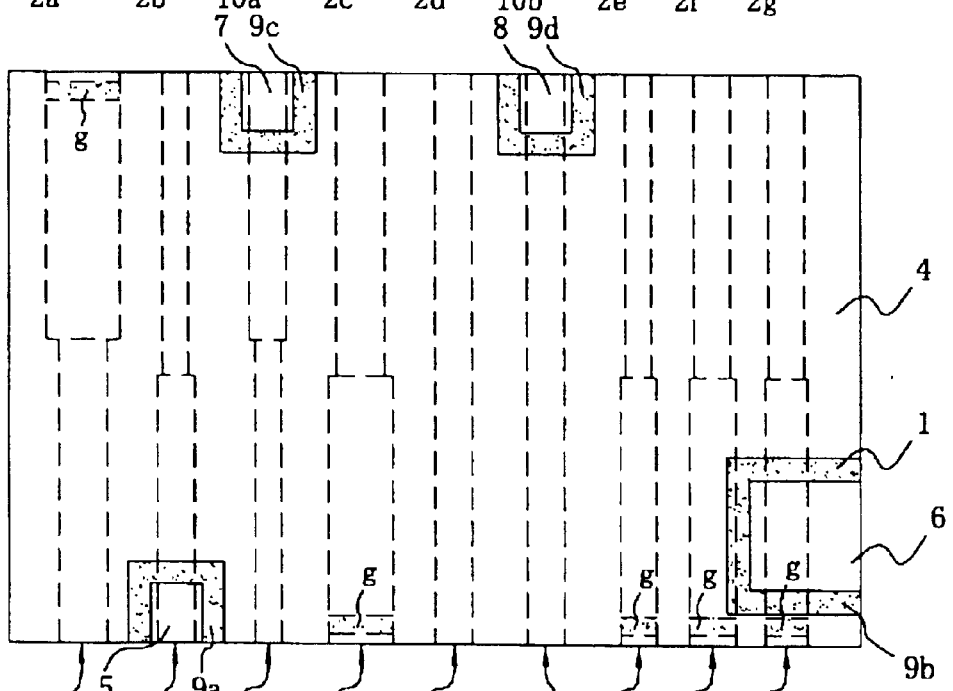
Figure 1C:
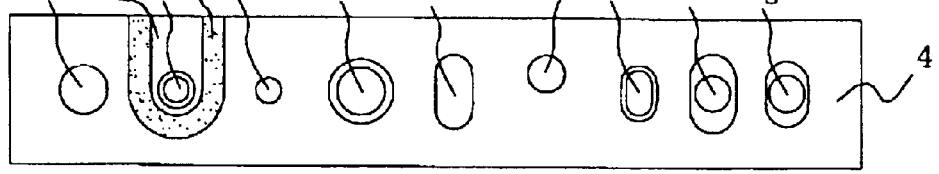

FIGS. 1A to 1C show three sides of the dielectric duplexer and externally-connected devices. Specifically, FIGS. 1A and 1C illustrate faces having apertures of inner-conductor-formed holes, and FIG. 1B illustrates the bottom face, which is a mounting face.

Figure 2:
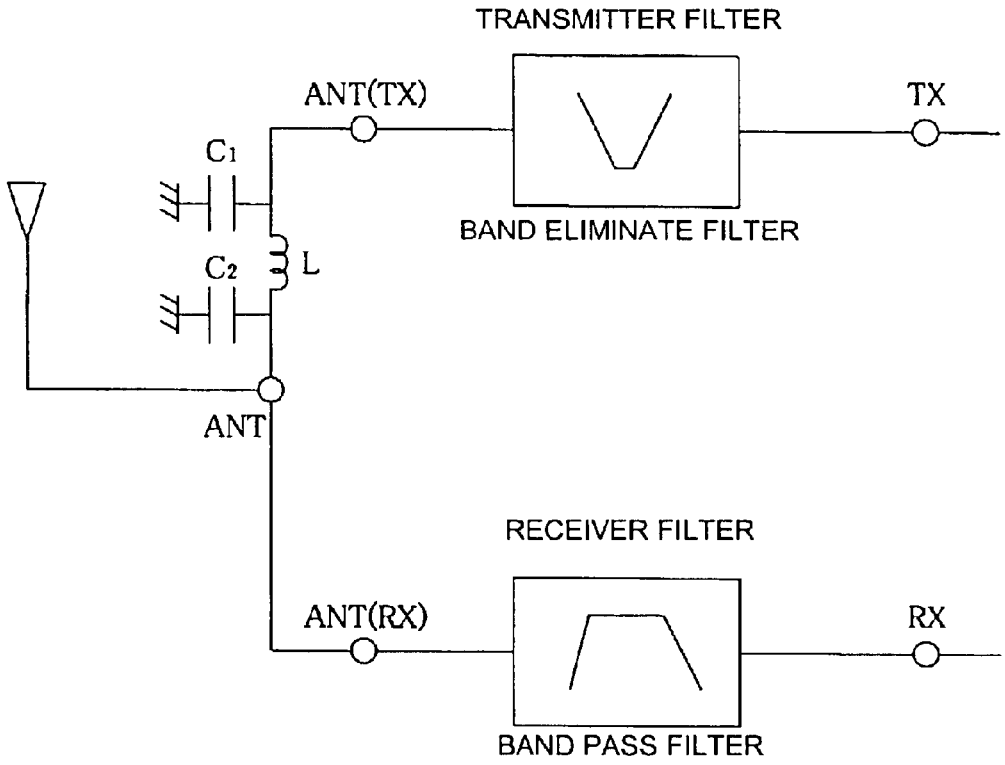
FIG. 2 is an equivalent circuit diagram of the dielectric duplexer according to the first embodiment.

FIG. 2 shows an equivalent circuit of the dielectric duplexer shown in FIGS. 1A to 1C.

Referring to FIGS. 1A to 1C, the dielectric duplexer includes a dielectric block 1; inner-conductor-formed holes 2*a* to 2*g*, 10*a*, and 10*b*, containing inner conductors; an outer conductor 4; an input electrode 5 serving as an input/output electrode of a transmitter filter; an output electrode 6 serving as an input/output electrode of a receiver filter; an antenna input/output electrode 7 for the transmitter filter; an antenna input/output electrode 8 for the receiver filter; outer-conductorless portions 9*a* to 9*d*; inner-conductorless portions g; an inductor L; capacitors $C_1$ and $C_2$; and an antenna ANT.

The dielectric block 1, which is preferably substantially-rectangular-parallelepiped-shaped, contains the inner-conductor-formed holes 2*a* to 2*g*, 10*a*, and 10*b* which contain the inner conductors. The inner-conductor-formed holes 2*a* to 2*g*, 10*a*, and 10*b* are formed to penetrate from a predetermined face (FIG. 1A) of the dielectric block 1 towards a face opposing the predetermined face (FIG. 1C). The inner-conductor-formed holes 2*a* to 2*c*, 2*e* to 2*g*, and 10*a* each preferably have a stepped hole structure formed by portions having different internal diameters. The inner-conductor-formed holes 2*a* and 10*a* are each preferably formed to have a larger internal diameter at the aperture side shown in FIG. 1A than that at the aperture side shown in FIG. 1C. The inner-conductor-formed holes 2*b*, 2*c*, and 2*e* to 2*g* are each preferably formed to have a larger internal diameter at the aperture side shown in FIG. 1C than that at the aperture side shown in FIG. 1A. The inner-conductor-formed holes 2*d* and 10*b* preferably have straight hole structures. For the inner-conductor-formed holes 2*a*, 2*c*, and 2*e* to 2*g*, the inner-conductorless portions g are preferably provided in the interior near the aperture side at which the inner-conductor-formed holes 2*a*, 2*c*, and 2*e* to 2*g* have larger internal diameters. Accordingly, open-circuited ends of corresponding resonators formed by the inner-conductor-formed holes 2*a*, 2*c*, and 2*e* to 2*g* are formed. The input electrode 5 (input/output electrode of the transmitter filter) is preferably formed to extend from one aperture side of the inner-conductor-formed hole 2*b* (FIG. 1C) to the bottom face, which is the mounting face (FIG. 1B) so that the input electrode 5 can be connected to the inner conductor in the inner-conductor-formed hole 2*b*. The outer-conductorless portion 9*b* is provided to extend from the bottom face to the right side of the dielectric block 1, thus forming the output electrode 6 (input/output electrode of the receiver filter), which is coupled to the inner conductor in the inner-conductor-formed hole 2*g*. The outer-conductorless portions 9*c* and 9*d* are provided to extend from the aperture side of the inner-conductor-formed holes 10*a* and 10*b* (FIG. 1A) to the bottom face, thus forming the antenna input/output electrodes 7 and 8, respectively, which are connected to the inner conductors of the inner-conductor-formed holes 10*a* and 10*b*.

A resonator formed by the inner-conductor-formed hole 2*a* and a resonator formed by the inner-conductor-formed hole 2*b* are interdigitally coupled to each other to form a one-stage band eliminate filter. Similarly, a resonator formed by the inner-conductor-formed hole 10*a* and a resonator formed by the inner-conductor-formed hole 2*c* form a one-stage band eliminate filter. In the band eliminate filters, the inner-conductor-formed hole 10*a* and the inner-conductor-formed hole 2*b* are interdigitally coupled to each other at an electrical angle of $\pi/2$ to form a two-stage band eliminate filter.

With this arrangement, the impedance of the transmitter filter, as seen from the antenna input/output electrode 7, in the frequency band of reception signals is substantially zero. Thus, the transmitter filter is essentially short-circuited.

In contrast, resonators formed by the inner-conductor-formed holes 2*e* to 2*g* are combline-coupled with one another to form a three-stage band pass filter. The antenna input/output electrode 8 is coupled via the inner-conductor-formed hole 10*b* to the resonator formed by the inner-conductor-formed hole 2*e*. As seen from the antenna input/output electrode 8, the impedance of the band pass filter, which is the receiver filter, in the frequency band of transmission signals is infinite. Thus, the receiver filter is essentially open-circuited.

The inner conductor in the inner-conductor-formed hole 2*d* is connected to the outer electrode 4 at both apertures. Thus, the inner-conductor-formed hole 2*d* functions as a ground hole. The foregoing two filters are electrically isolated from each other by the inner-conductor-formed hole 2*d*.

A $\pi/2$ phase circuit including the capacitors $C_1$ and $C_2$ and the inductor L, which are coupled to one another in the shape of the letter $\pi$, is provided between the antenna input/output electrode 7 of the transmitter filter and the antenna input/output electrode 8 of the receiver filter. The antenna ANT is directly connected to the input/output electrode 8 of the receiver filter.

Figure 3:
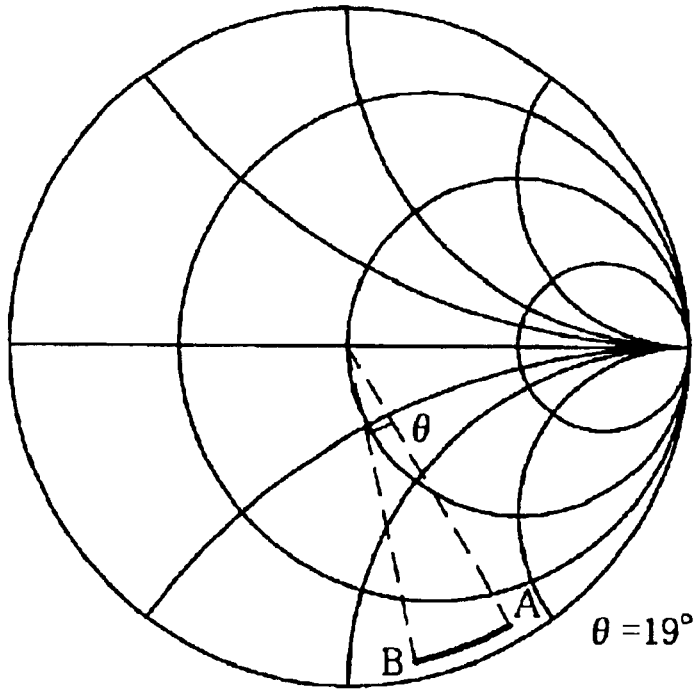
FIG. 3 is a Smith chart showing the impedance of a transmitter filter in a reception band as seen from an antenna of the dielectric duplexer according to the first embodiment.

FIG. 3 is a Smith chart showing the impedance of the transmitter filter in the reception band as seen from the antenna. The Smith chart shows the impedance of a communication system in the 800 MHz band (the pass band of the receiver filter ranges from 810 MHz to 828 MHz), wherein symbol A indicates the impedance at 810 MHz and symbol B indicates the impedance at 828 MHz.

Figure 9:
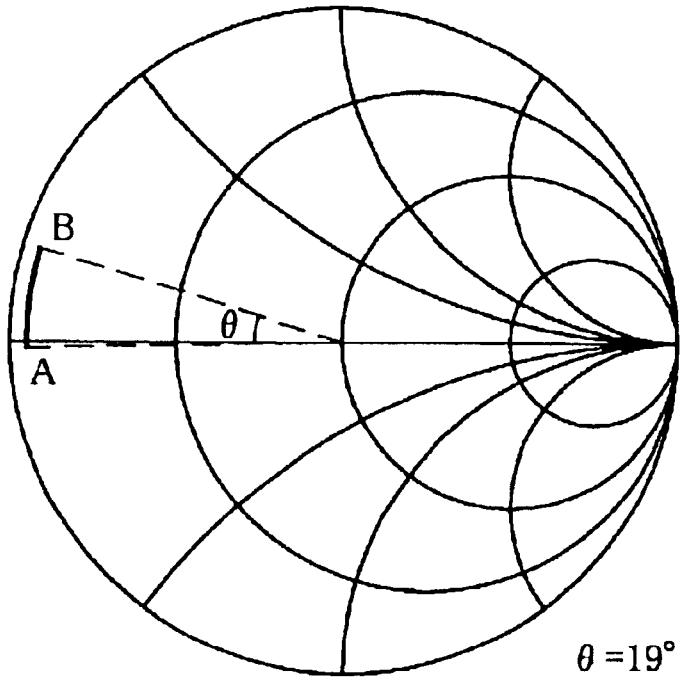
FIG. 9 PRIOR ART
FIG. 9 is a Smith chart showing the impedance of a transmitter filter in a reception band as seen from an antenna of the duplexer shown in FIG. 8.
Figure 10A:
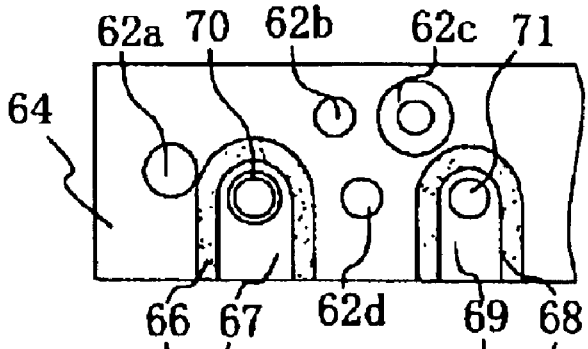
FIG. 10A PRIOR ART
FIGS. 10A to 10C are partial views of the bottom face and sides of another known dielectric duplexer.
Figure 10B:
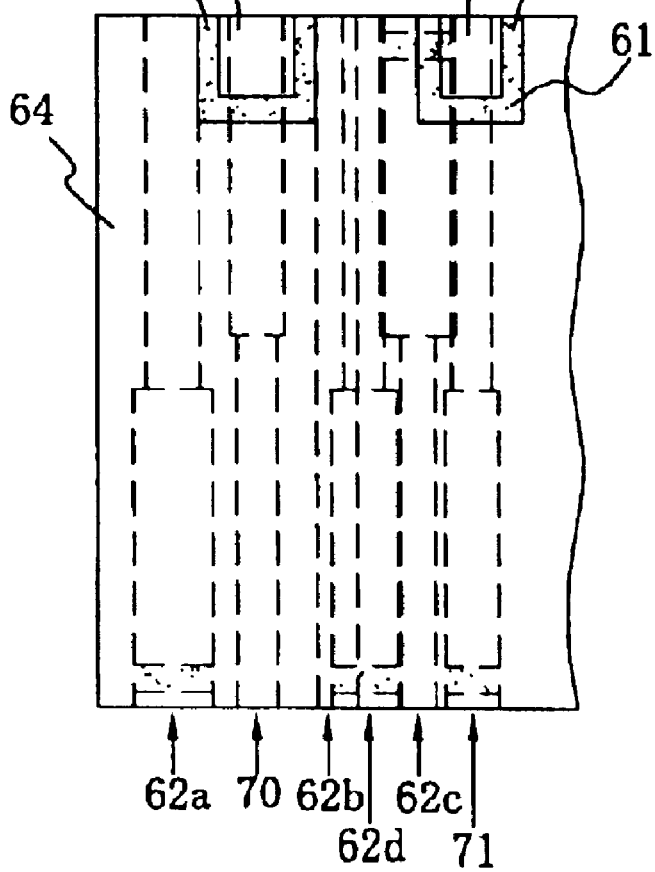
FIG. 10B PRIOR ART
Figure 10C:
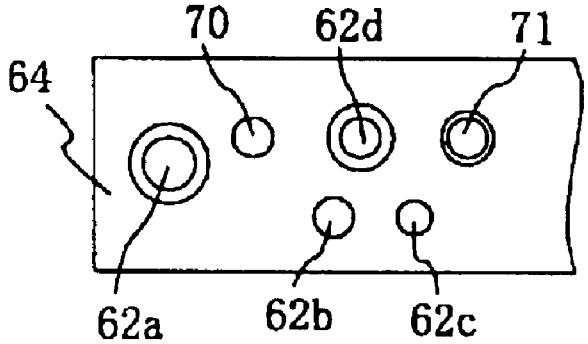
FIG. 10C PRIOR ART

The comparison between FIG. 3 and FIG. 9 shows that the impedance is increased by providing the phase circuit. The transmitter filter as seen from the antenna ANT is equivalent to an open-circuited end in the pass band of the receiver filter (the frequency band of reception signals). As a result, the filters function as a duplexer.

Figure 11:
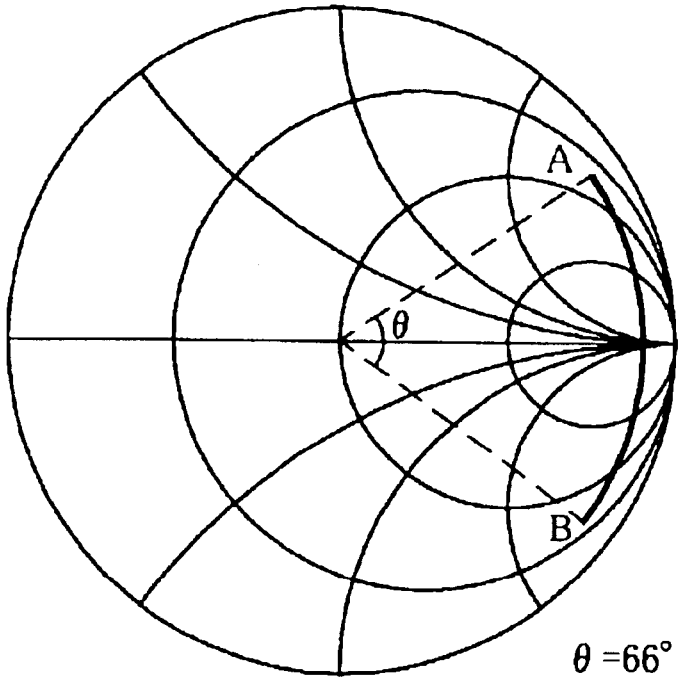
FIG. 11 PRIOR ART
FIG. 11 is a Smith chart showing the impedance of a transmitter filter in a reception band as seen from an antenna of the known dielectric duplexer shown in FIG. 10.

Also, the comparison between FIG. 3 and FIG. 11 shows that the dielectric duplexer according to the first embodiment has a smaller width of phase change over the entire frequency band.

Specifically, the number of resonators forming the filter is reduced to reduce the number of devices having frequency characteristics. Thus, the phase range can be reduced. This results in lessening the influence of a phase shift in the reception band and hence improves the matching characteristics of the receiver filter. As a result, the insertion loss of the receiver filter can be reduced, and deterioration in the characteristics can be suppressed.

Accordingly, the dielectric duplexer can be formed by connecting the phase circuit to the exterior of the dielectric block including the transmitter filter, as the band eliminate filter, and the receiver filter, as the band pass filter.

With this arrangement, the transmitter filter can be formed by a band eliminate filter without a phase circuit within the dielectric block. Therefore, the dimensions of the dielectric block 1 can be reduced. For example, the dimensions of a dielectric block used in a known dielectric duplexer having resonators at two stages from the top face to the bottom face are 6.5 mm×9.0 mm×2.54 mm. In contrast, the dimensions of the dielectric block according to the first embodiment of the present invention are 5.6 mm×9.0 mm×1.94 mm. In the first embodiment, the mounting area and the height are reduced. The dimensions of the externally connected chip coil and chip capacitors forming the phase circuit are 1.0 mm×0.5 mm×0.5 mm. Considering the mounting area for the phase circuit, the dielectric duplexer can be minimized even when the phase circuit is mounted.

The inner-conductor-formed holes in the dielectric block are preferably formed and arranged along a line extending from a first side of the dielectric block to a second side opposing the first side. With this, an increase in the insertion loss can be suppressed without reducing the unloaded Q factor. For example, the dielectric duplexer of the first embodiment has an insertion loss of 0.69 dB (including losses in the externally connected phase circuit), whereas a known dielectric duplexer has an insertion loss of 0.80 dB.

Instead of using phase rotation resonators formed by inner-conductor-formed holes arranged at two stages, the use of a lumped-constant circuit can reduce the frequency dependency and can reduce the phase width in the reception band.

Comparing FIG. 11, which illustrates a known dielectric duplexer, and FIG. 3, which illustrates the dielectric duplexer of the first embodiment, the phase shift is improved in the first embodiment. That is, the phase width is changed from 66 degrees to 19 degrees. An experiment showed that the insertion loss of the receiver filter, including losses in the externally connected phase circuit, was improved from 1.73 dB to 1.39 dB.

The manufacturing cost can be reduced due to the following reasons:

(1) Since the dimensions of the dielectric block are reduced, the material cost is reduced;

(2) Since the number of resonators formed by the inner-conductor-formed holes and the corresponding inner conductors in the dielectric block is reduced, the mold cost is reduced; and (3) Since the number of resonators is reduced, the processing cost is reduced.

Although the phase circuit is formed by a C-L-C π-shaped circuit in the first embodiment, the phase circuit is not limited to this type. The phase circuit can be formed by an L-C-L π-shaped phase circuit, a capacitor (C) connected in series, or an inductor (L) connected in parallel. When the C-L-C π-shaped circuit is used, the attenuation characteristics in the high frequency domain in the elimination band of the transmitter filter and the pass band of the receiver filter can be improved. With the single L or C circuit, the phase rotation may not be sufficient. By changing the shape of the inner-conductor-formed hole connected to the antenna input/output electrode to a stepped hole, the resonant frequency of transmission signals can be changed to achieve the desired characteristics.

Alternatively, the transmitter filter can be a band pass filter, and the receiver filter can be a band eliminate filter. In this case, the antenna input/output electrode for the transmitter filter is directly connected to the antenna. The impedance of the receiver filter, as seen from the antenna input/output electrode for the transmitter filter, in the frequency band of transmission signals becomes infinite, and thus the receiver filter can be considered to be essentially open-circuited. Accordingly, the two filters can function as a duplexer.

Figure 4A:
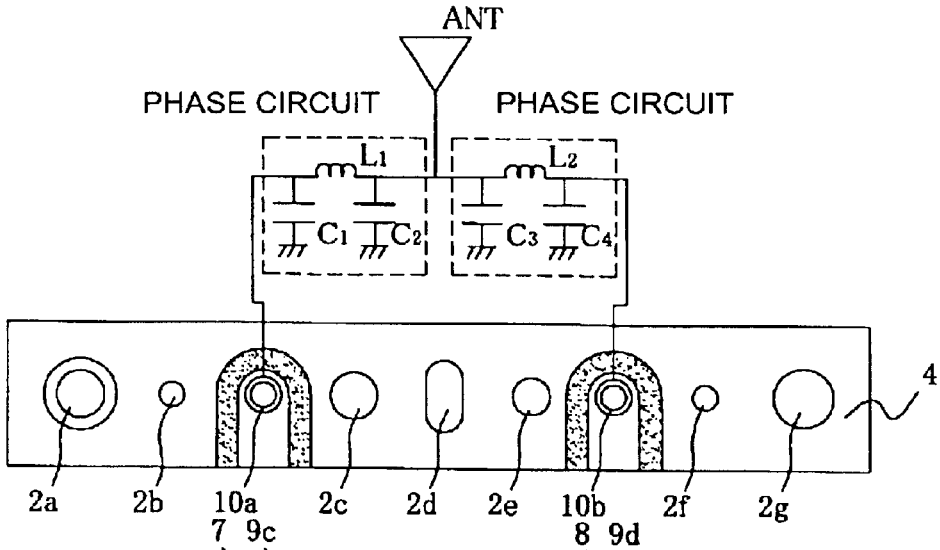
FIGS. 4A to 4C are three side views of a dielectric duplexer, with externally-connected devices, according to a second embodiment of the present invention.
Figure 4B:
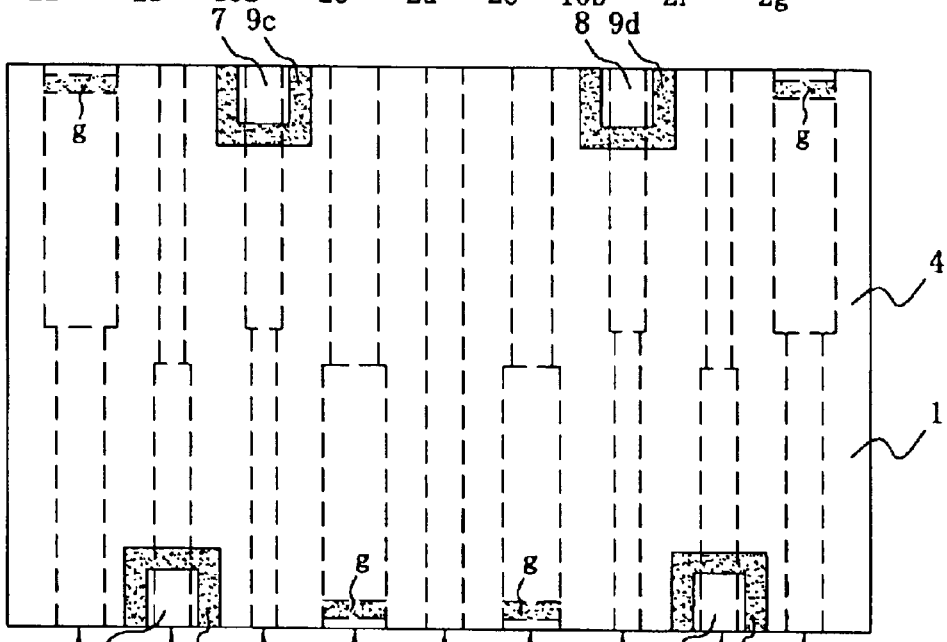
Figure 4C:
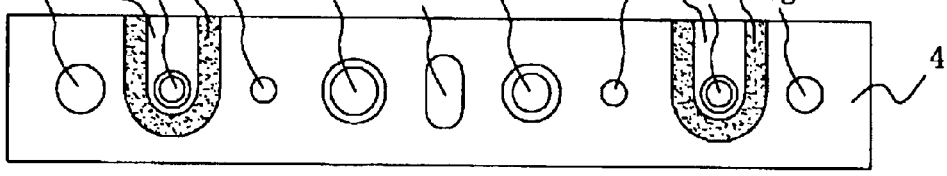

Referring to FIGS. 4A to 4C, the configuration of a dielectric duplexer according to a second embodiment of the present invention will now be described.

FIGS. 4A to 4C illustrates three sides of the dielectric duplexer and externally-connected devices. Specifically, FIGS. 4A and 4C illustrate apertures of inner-conductor-formed holes, and FIG. 4B illustrates the bottom face, which is a mounting face.

Referring to FIGS. 4A to 4C, the dielectric duplexer includes a dielectric block 1; inner-conductor-formed holes 2*a* to 2*g*, 10*a*, and 10*b* containing inner conductors; an outer conductor 4; an input electrode 5 serving as an input/output electrode of a transmitter filter; an output electrode 6 serving as an input/output electrode of a receiver filter; an antenna input/output electrode 7 for the transmitter filter; an antenna input/output electrode 8 for the receiver filter; outer-conductorless portions 9*a* to 9*d*; inner-conductorless portions g; inductors $L_1$ and $L_2$; capacitors $C_1$, $C_2$, $C_3$, and $C_4$; and an antenna ANT.

The dielectric duplexer shown in FIGS. 4A to 4C includes the transmitter filter, which is also a band eliminate filter including the inner-conductor-formed holes 2*a* to 2*c* and 10*a*, and the receiver filter, which is also a band eliminate filter including the inner-conductor-formed holes 2*e* to 2*g* and 10*b*. The band eliminate filter including the inner-conductor-formed holes 2*a* to 2*c* and 10*a* (the transmitter filter), has the same structure as that of the band eliminate filter of the dielectric duplexer according to the first embodiment of the present invention. In contrast, the band eliminate filter including the inner-conductor-formed holes 2*e* to 2*g* and 10*b* (the receiver filter), is preferably formed as a mirror image of the band eliminate filter including the inner-conductor-formed holes 2*a* to 2*c* and 10*a* with respect to the axis of symmetry, which is the axial direction of the inner-conductor-formed hole 2*d* serving as a ground hole. The inner-conductor-formed holes 2*e* to 2*g* and 10*b* preferably have different internal diameters and stepped structures compared with those of the inner-conductor-formed holes 2*a* to 2*c* and 10*a*, thus shifting the resonant frequencies of the transmitter filter and the receiver filter. As a result, the transmitter filter and the receiver filter have different operating frequency bands.

The input electrode 5 and the antenna input/output electrode 7 are the same as those shown in the first embodiment. As in the above-described inner-conductor-formed holes, the output electrode 6 and the antenna input/output electrode 8 are formed to be symmetrical with the input electrode 5 and the antenna input/output electrode 7 with respect to the axis of the inner-conductor-formed hole 2*d*.

A π/2 phase circuit including the capacitors $C_1$ and $C_2$ and the inductor $L_1$, which are coupled to one another in the shape of the letter π, is provided between the antenna input/output electrode 7 of the transmitter filter and the antenna ANT. Thus, the transmitter filter in the operating frequency band of the receiver filter (reception frequency band) as seen from the antenna ANT is essentially open-circuited. Another π/2 phase circuit including the capacitors $C_3$ and $C_4$ and the inductor $L_2$, which are coupled to one another in the shape of the letter π, is provided between the antenna ANT and the antenna input/output electrode 8 of the receiver filter. Thus, the receiver filter in the operating frequency band of the transmitter filter (transmission frequency band) as seen from the antenna ANT is essentially open-circuited. Accordingly, a transmission signal from the transmitter filter is transmitted to the antenna without being directly transmitted to the receiver filter, and a reception signal from the antenna is transmitted to the receiver filter without being transmitted to the transmitter filter. The transmitter filter and the receiver filter thus function as a dielectric duplexer.

Figure 5A:
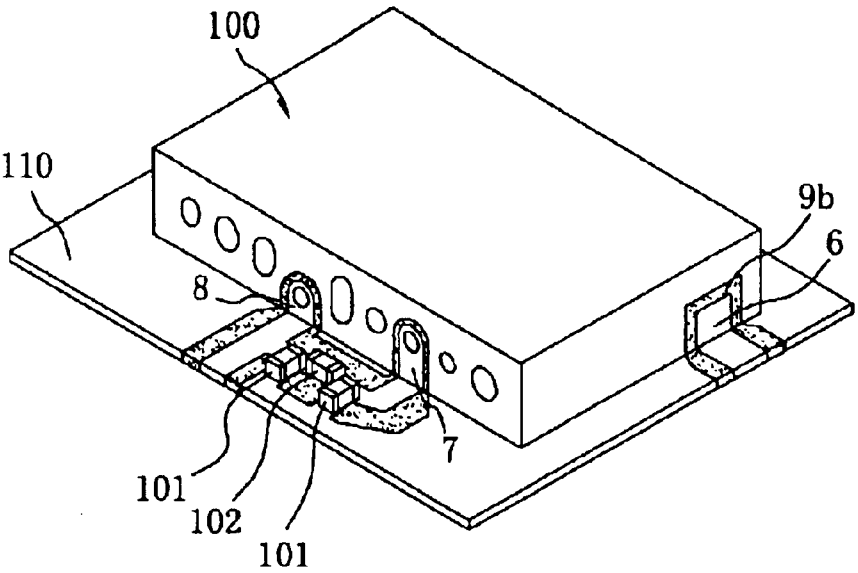
FIGS. 5A and 5B are external perspective views of a dielectric duplexer according to a third embodiment of the present invention.
Figure 5B:
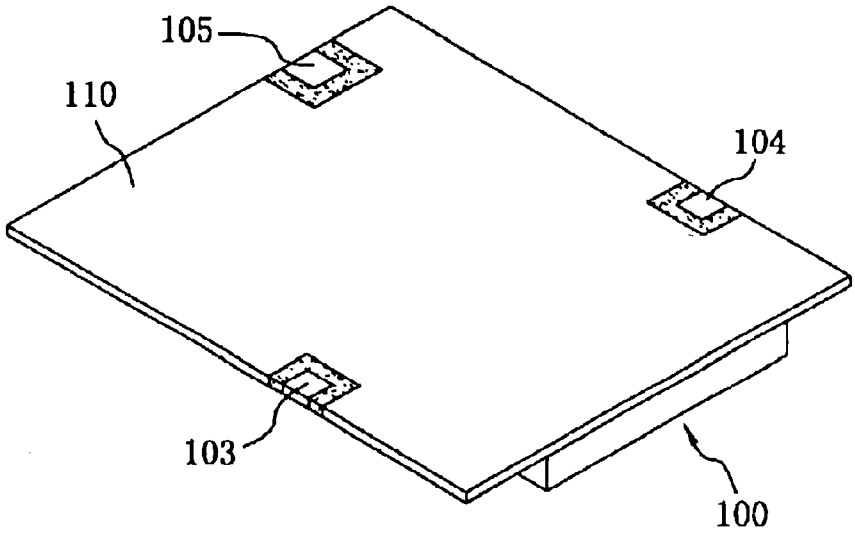

Referring to FIGS. 5A and 5B, the configuration of an RF module according to an aspect of the present invention will now be described.

FIGS. 5A and 5B are external perspective views of the dielectric duplexer, including the top face shown in FIG. 5A and the bottom face shown in FIG. 5B.

Referring to FIGS. 5A and 5B, the dielectric duplexer includes a dielectric block 100, chip capacitors 101, a chip coil 102, an antenna terminal 103, an input terminal 104, an output terminal 105, and a substrate 110.

The configuration of the dielectric block 100 shown in FIGS. 5A and 5B is the same as that illustrated in the first embodiment.

Referring to FIG. 5A, a surface mounted circuit is formed on one side of the substrate 100, on which the dielectric block 100, the chip capacitors 101, and the chip coil 102 are mounted. The chip capacitors 101 and the chip coil 102 are mounted in the shape of the letter $\pi$ to form a $\pi/2$ phase circuit. The $\pi/2$ phase circuit is connected to the antenna input/output electrode 7 of the transmitter filter, the antenna input/output electrode 8 of the receiver filter, and the antenna terminal 103 formed on the substrate 110. The input electrode of the transmitter filter of the dielectric block 100 is connected to the input terminal 104 formed on the substrate 110, and the output electrode of the receiver filter is connected to the output terminal 105 formed on the substrate 110. In this manner, the devices are mounted on the surface of the substrate 110, and all the devices form a radio frequency (RF) module functioning as a dielectric duplexer.

With this arrangement, the devices mounted on the substrate are integrated into a single duplexer. This arrangement eliminates the necessity for providing an additional external circuit.

Since the input terminal, output terminal, and antenna terminal of arbitrary sizes can be provided at arbitrary positions on the substrate, the degree of freedom in designating the duplexer can be enhanced.

The open ends of the resonators using the inner-conductor-formed holes in the dielectric block in the foregoing embodiments are not limited to those formed using the inner-conductorless portions g provided in the interior of the inner-conductor-formed holes near the end face serving as the open-circuited end face. Alternatively, no outer conductor is formed on the open-circuited end face, and the apertures of the inner-conductor-formed holes thus serve as open-circuited end. The apertures can be provided with coupling electrodes connected to the inner conductors.

Figure 6:
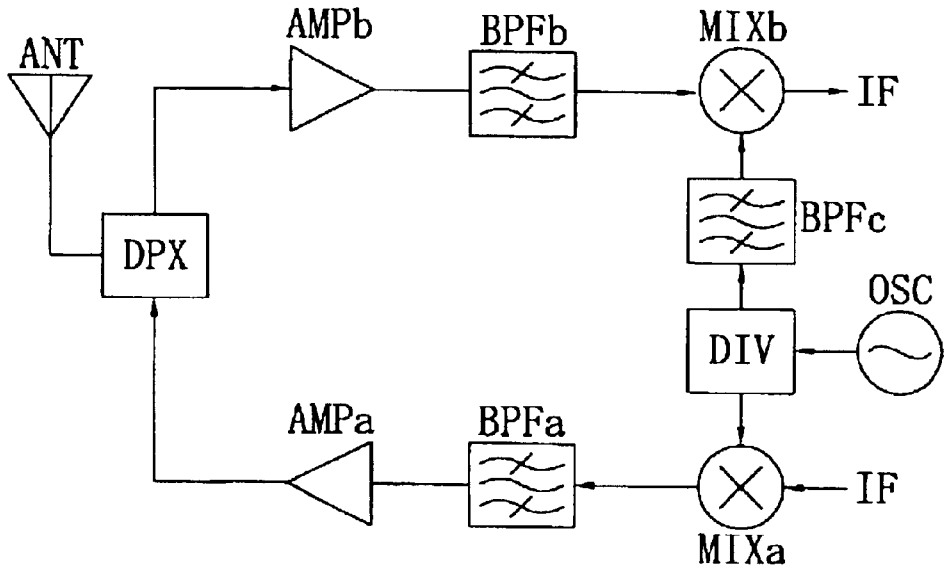
FIG. 6 is a block diagram of a communication apparatus according to a fourth embodiment of the present invention.
Figure 7:
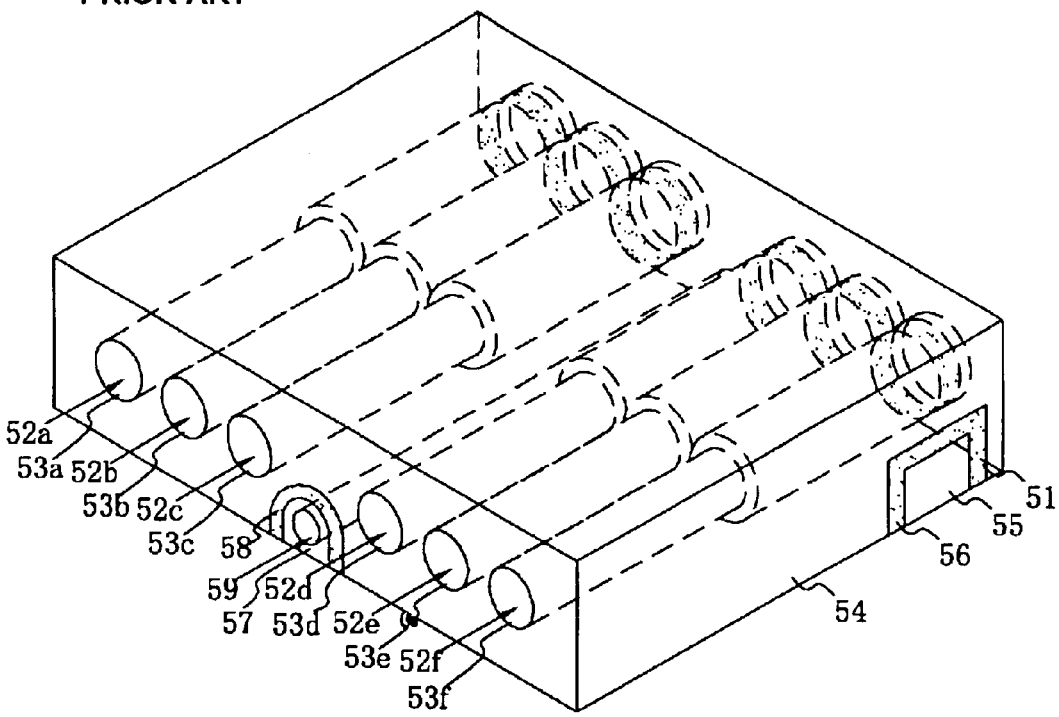
FIG. 7 PRIOR ART
FIG. 7 is an external perspective view of a known dielectric duplexer.
Figure 8:
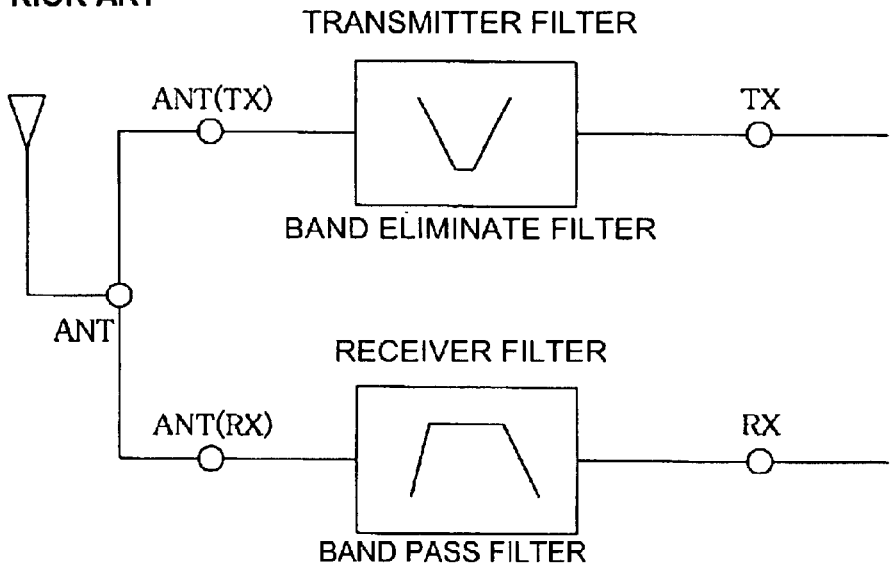
FIG. 8 PRIOR ART
FIG. 8 is an equivalent circuit diagram of a duplexer including a band eliminate filter and a band pass filter.

Referring to FIG. 6, the configuration of a communication apparatus according to an aspect of the present invention will now be described.

FIG. 6 is a block diagram of the communication apparatus.

Referring to FIG. 6, the communication apparatus includes a transmitter/receiver antenna ANT; a duplexer DPX; band pass filters BPFa, BPFb, and BPFc; amplifier circuits AMPa and AMPb; mixers MIXa and MIXb; an oscillator OSC; and a frequency divider (synthesizer) DIV. The mixer MIXa modulates a frequency signal output from the frequency divider DIV using an intermediate frequency (IF) signal. The band pass filter BPFa only allows a signal within the transmission frequency band. The amplifier circuit AMPa amplifies the signal that has passed through the band pass filter BPFa and transmits the signal from the antenna ANT through the duplexer DPX. The amplifier circuit AMPb amplifies a signal output from the duplexer DPX. Of the signal output from the amplifier circuit AMPb, the band pass filter BPFb only allows a signal within the reception frequency band. The mixer MIXb mixes a frequency signal output from the band pass filter BPFc and a receiver signal and outputs an IF signal.

The dielectric duplexers formed as shown in FIGS. 1A to 1C, 4A to 4C, 5A, and 5B can be used as the duplexer DPX shown in FIG. 6. Accordingly, a miniaturized communication apparatus having improved transmission characteristics can be formed.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric duplexer comprising:

a dielectric block;

an outer conductor on exterior surfaces of the dielectric block;

a first filter forming a band eliminate filter which includes:

a first plurality of conductive through holes formed in the dielectric block;

a first antenna input/output electrode coupled to a first conductive through hole of the first plurality of conductive through holes; and a first input/output electrode coupled to a second conductive through hole of the first plurality of conductive through holes;

a second filter which includes:

a second plurality of conductive through holes formed in the dielectric block;

a second antenna input/output electrode coupled to a first conductive through hole of the second plurality of conductive through holes; and a second input/output electrode coupled to a second conductive through hole of the second plurality of conductive through holes; and a phase circuit exterior to the dielectric block and provided between the antenna input/output electrode of the band eliminate filter and an antenna, wherein a phase is shifted by the phase circuit so that the first antenna input/output electrode of the band eliminate filter becomes open-circuited.

2. The dielectric duplexer according to claim 1, wherein the second filter is a band pass filter, and the antenna is connected to the second antenna input/output electrode of the band pass filter.

3. The dielectric duplexer according to claim 1, wherein the band eliminate filter is formed by interdigitally coupling the first conductive through hole and the second conductive through hole of the band eliminate filter with each other.

4. The dielectric duplexer according to claim 1, wherein the phase circuit and the dielectric block including at least the band eliminate filter are mounted on a single substrate.

5. A communication apparatus comprising a dielectric duplexer as set forth in claim 1.

6. The dielectric duplexer according to claim 1, wherein at least one of the conductive through holes of the first plurality of conductive through holes has a stepped structure.

7. The dielectric duplexer according to claim 1, wherein at least one of the conductive through holes of the second plurality of conductive through holes has a stepped structure.

8. The dielectric duplexer according to claim 1, wherein first filter and the second filter are separated by a ground hole.

9. The dielectric duplexer according to claim 1, wherein the first filter is formed by a first one-stage band eliminate filter and a second one-stage band eliminate filter interdigitally coupled to each other.

10. The dielectric duplexer according to claim 9, wherein the first one-stage band eliminate filter and the second one-stage band eliminate filter are interdigitally coupled to each other at an electrical angle of $\pi/2$ to form a two-stage band eliminate filter.

11. The dielectric duplexer according to claim 1, wherein the phase circuit is a $\pi/2$ phase circuit.

12. The dielectric duplexer according to claim 1, wherein an axis of each of the first plurality of conductive through holes are arranged along a common line.

13. A dielectric duplexer comprising:

a dielectric block;

an outer conductor on exterior surfaces of the dielectric block;

a first band eliminate filter which includes:

a first plurality of conductive through holes formed in the dielectric block;

a first antenna input/output electrode coupled to a first conductive through hole of the first plurality of conductive through holes; and a first input/output electrode coupled to a second conductive through hole of the first plurality of conductive through holes;

a second band eliminate filter which includes:

a second plurality of conductive through holes formed in the dielectric block;

a second antenna input/output electrode coupled to a first conductive through hole of the second plurality of conductive through holes; and a second input/output electrode coupled to a second conductive through hole of the second plurality of conductive through holes;

a first phase circuit exterior to the dielectric block and provided between the first antenna input/output electrode of the first band eliminate filter and an antenna; and a second phase circuit exterior to the dielectric block and provided between the second antenna input/output electrode of the second band eliminate filter and the antenna.

14. The dielectric duplexer according to claim 13, wherein first band eliminate filter and the second band eliminate filter are separated by a ground hole.

15. The dielectric duplexer according to claim 13, wherein the first filter is formed by a first one-stage band eliminate filter and a second one-stage band eliminate filter interdigitally coupled to each other.

16. The dielectric duplexer according to claim 15, wherein the first one-stage band eliminate filter and the second one-stage band eliminate filter are interdigitally coupled to each other at an electrical angle of $\pi/2$ to form a two-stage band eliminate filter.

17. The dielectric duplexer according to claim 13, wherein the first phase circuit is a $\pi/2$ phase circuit.

18. The dielectric duplexer according to claim 13, wherein the second phase circuit is a $\pi/2$ phase circuit.

19. The dielectric duplexer according to claim 13, wherein an axis of each of the first plurality of conductive through holes are arranged along a common line.

20. The dielectric duplexer according to claim 13, wherein an axis of each of the second plurality of conductive through holes are arranged along a common line.

* * * * *